US011149421B2

(12) United States Patent
Liang et al.

(10) Patent No.: US 11,149,421 B2
(45) Date of Patent: Oct. 19, 2021

(54) EMBEDDED SINK

(71) Applicant: GUANGDONG YINGAO KITCHEN UTENSILS CO., LTD., Foshan (CN)

(72) Inventors: Huakun Liang, Foshan (CN); Jiazhi Chen, Foshan (CN)

(73) Assignee: GUANGDONG YINGAO KITCHEN UTENSILS CO., LTD., Foshan (CN)

( * ) Notice: Subject to any disclaimer, the term of this patent is extended or adjusted under 35 U.S.C. 154(b) by 0 days.

(21) Appl. No.: 16/847,601

(22) Filed: Apr. 13, 2020

(65) Prior Publication Data

US 2020/0399877 A1 Dec. 24, 2020

(30) Foreign Application Priority Data

Jun. 18, 2019 (CN) ..... 201920923656.9

(51) Int. Cl.
*A47B 77/06* (2006.01)
*E03C 1/18* (2006.01)

(52) U.S. Cl.
CPC ..... *E03C 1/18* (2013.01); *A47B 77/06* (2013.01); *A47B 2220/03* (2013.01)

(58) Field of Classification Search
CPC ..... A47B 77/06; A47B 2220/03; E03C 1/14; E03C 1/16; E03C 1/18; E03C 1/182; E03C 1/32
See application file for complete search history.

(56) References Cited

U.S. PATENT DOCUMENTS

| | | | | |
|---|---|---|---|---|
| 6,154,895 | A * | 12/2000 | Pisklak | E03C 1/18 4/584 |
| D624,635 | S * | 9/2010 | Eckhaus | D23/308 |
| 10,151,085 | B2 * | 12/2018 | Chong | E03C 1/182 |
| 10,844,582 | B1 * | 11/2020 | Hocaoglu | E03C 1/182 |
| 2005/0223486 | A1 * | 10/2005 | Jumalon | A47B 77/06 4/619 |
| 2012/0204343 | A1 * | 8/2012 | Shollmier | E03C 1/18 4/631 |
| 2018/0187400 | A1 * | 7/2018 | Chong | E03C 1/18 |
| 2020/0407956 | A1 * | 12/2020 | Zeng | E03C 1/18 |

* cited by examiner

*Primary Examiner* — Erin Deery

(57) ABSTRACT

The present application provides an embedded sink, comprising a basin liner and a mounting panel; the basin liner comprises a bottom plate and a side plate, the bottom plate and the side plates are suitable to be connected to form a cavity having an upper opening, the basin liner is suitable for embedded installation in a cabinet, and the front side plate of the basin liner protrudes relative to the cabinet; the mounting panel is detachably connected to the front side plate of the basin liner, the mounting panel is suitable to cover the front side plate of the basin liner. The embedded sink of the present application can avoid destructive alterations of the embedded sink on the basis of improving the overall visual consistency of the cabinet.

2 Claims, 5 Drawing Sheets

EMBEDDED SINK

TECHNICAL FIELD

The application relates to the technical field of sink, and in particular to an embedded sink.

BACKGROUND

There are various types of sinks on the market, one of the more common is the embedded sink, the embedded sink, that is, the sink is used built into the cabinet, so that the entire kitchen can looks neater and more beautiful. At present, most sinks on the market are made of stainless steel, the color of sinks is relatively single, but there are more types and colors of cabinets, then when the part of the embedded sink exposed outside the cabinet is significantly different from the overall color of the cabinet, it will affect the visual consistency of the kitchen.

In order to ensure visual consistency, people often make destructive alterations to exposed parts of embedded sinks, such as spraying paint directly to the exposed part, or installing panels with similar materials and colors to cabinets by using glue and welding, although processing the embedded sink in this way can improve visual consistency, for different cabinets, it is very troublesome to buy a new embedded sink and repeat the above operation.

SUMMARY

In order to overcome the deficiencies of the conventional technology, the object of the present application is to provide an embedded sink, which can avoid destructive alterations of the embedded sink on the basis of improving the overall visual consistency of the cabinet.

The object of the present application is achieved by the following technical solutions:

An embedded sink, comprising a basin liner and a mounting panel; the basin liner comprises a bottom plate and side plates, the bottom plate and the side plates are collectively connected to form a cavity having an upper opening, the basin liner is suitable for embedded installation in a cabinet, and a front side plate of the basin liner protrudes relative to the cabinet; the mounting panel is detachably connected to the front side plate of the basin liner, the mounting panel is structured and arranged to cover the front side plate of the basin liner.

Further, a top plate of the basin liner is provided above the front side plate of the basin liner, the top plate is parallel to the bottom plate and provided with a plurality of bolts, the plurality of the bolts is disposed downward; the mounting panel comprises a front panel and a bolt connection panel; the bolt connection panel is located on a top of the front panel, the bolt connection panel is provided with a perspective bolt opening corresponding to each of the plurality of the bolts, each of the plurality of the bolts is configured to insert into the perspective bolt opening, each of the plurality of the bolts is provided with a nut for locking the mounting panel.

Further, the perspective bolt opening comprises a fixed opening and a guiding opening, the fixed opening matches a diameter of the perspective bolt, a width of the guiding opening is larger than a diameter of the bolt opening, the fixed opening communicates with the guiding opening.

Further, an outside of the left side panel of the basin liner is provided with a left fastening plate, the left fastening plate is parallel to the left side panel, a front side of the left fastening plate is provided with a first hook, an outside of the right side panel of the basin liner is provided with a right fastening plate, the right fastening plate is parallel to the right side panel, the front side of the right fastening plate is provided with a second hook; the mounting panel further comprises a left panel locating on a left of the front panel and a right panel locating on a right of the front panel, the left panel is provided with a first hook hole, the right panel is provide with a second hook hole; the first hook on the left fastening plate is configured to cooperate with the second hook hole on the right panel, the second hook on the right fastening plate is suitable to cooperate with the first hook hole on the left panel.

Further, the mounting panel further comprises a bottom panel at a bottom of the front panel, the bottom panel is provided with a reserved hole corresponding to the fixed opening.

Compared with the prior art, the beneficial effects of the present application are: the mounting panel is detachably connected to the front side plate of the basin liner, then when the embedded sink of the present application is installed in different cabinets, the corresponding mounting panel can be replaced according to the color and material of the cabinet, that is, by means of detachable connection, it can avoid damage to the embedded sink on the basis of improving the overall visual consistency of the cabinet.

In the Figure: 1, basin liner; 11, bottom plate; 12, front side plate; 13, back side plate; 14, left side plate; 15, right side plate; 16, top plate; 17, left fastening plate; 18, right fastening plate; 19, hook; 2, mounting panel; 21, front panel; 22, bolt connection panel; 221, bolt opening; 2211, guiding opening; 2212, fixed opening; 23, left panel; 24, right panel; 25, hook hole; 26, bottom panel; 261, reserved hole; 3, bolt; 4, nut.

DESCRIPTION OF EMBODIMENTS

To facilitate understanding of the present application, the present application will be described more fully with reference to the related drawings. However, the present application can be implemented in many different forms and is not limited to the embodiments described herein. Conversely, these examples are provided to provide a clearer and more comprehensive understanding of the disclosure of the present application.

It should be noted that when a component is referred to be "fixed to" another component, it can be directly on the other component or it can have a centered component. When a component is considered to "connect" another component, it can be directly connected to another component or it may have a centered component at the same time. When a component is considered to "set to" another component, it can be directly connected to another component or it may have a centered component at the same time. The terms "vertical," "horizontal," "left," "right," and the like, as used herein, are for illustrative purposes only.

Unless defined otherwise, all technical and scientific terms used herein have the same meaning as commonly understood by those skilled in the art to which this application belongs. The terminology used herein is for the purpose of describing particular embodiments, and is not intended to limit the application. The term "and/or" as used herein includes any and all combinations of one or more of the associated listed items.

Figure 1:
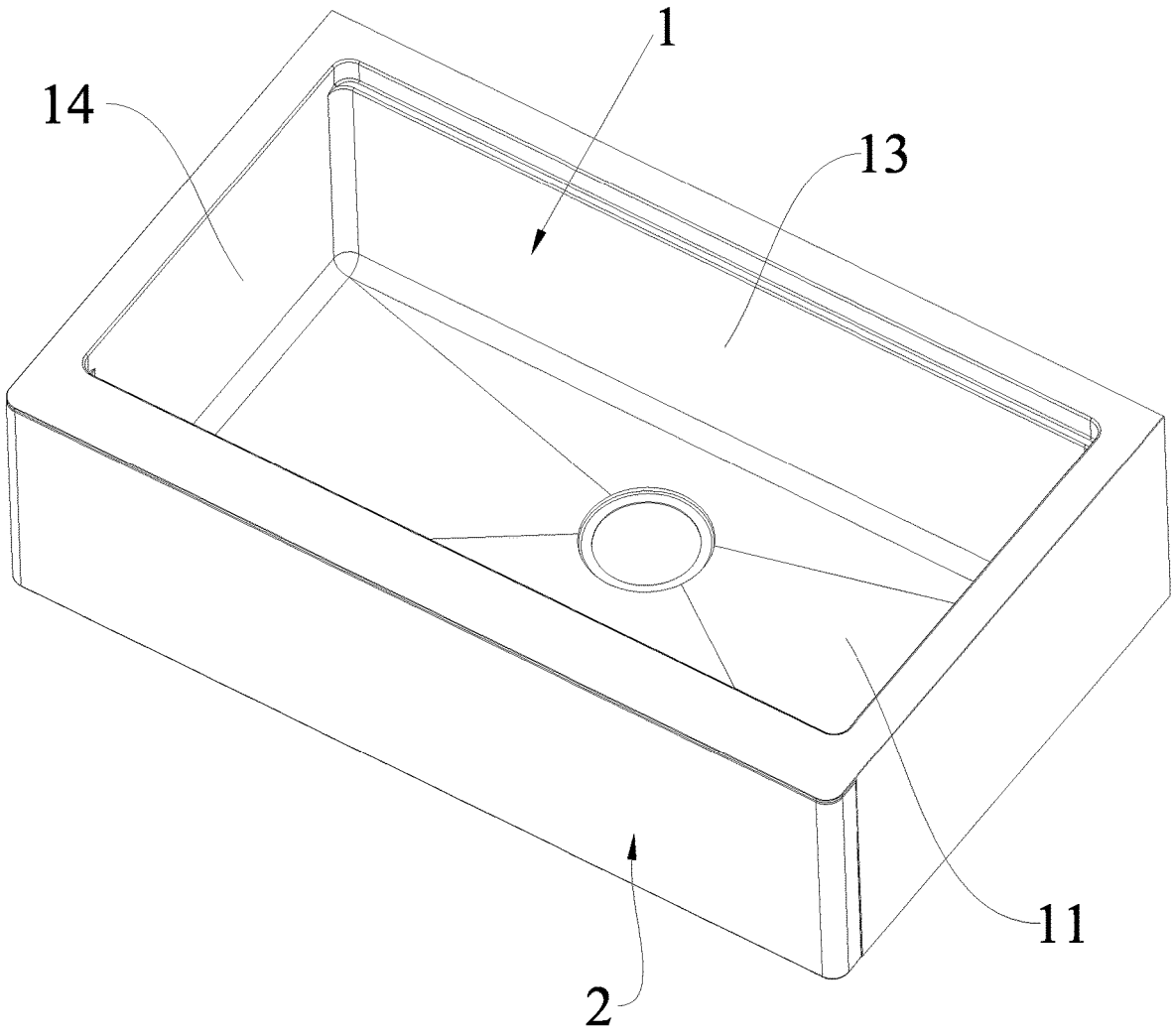
FIG. 1 is a perspective view of the embedded sink of the present application from a first perspective.
Figure 2:
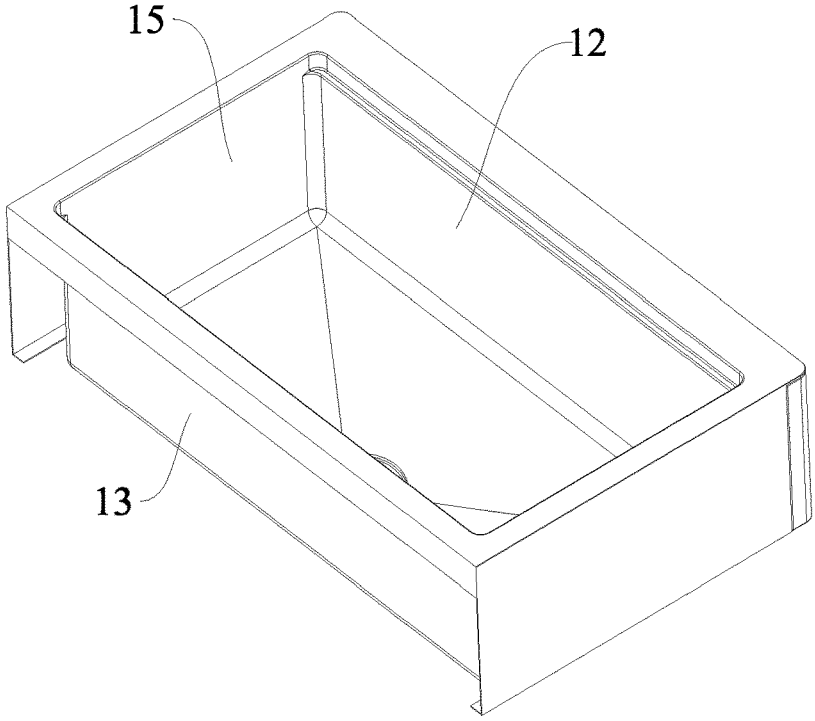
FIG. 2 is a perspective view of the embedded sink of the present application from a second perspective.
Figure 3:
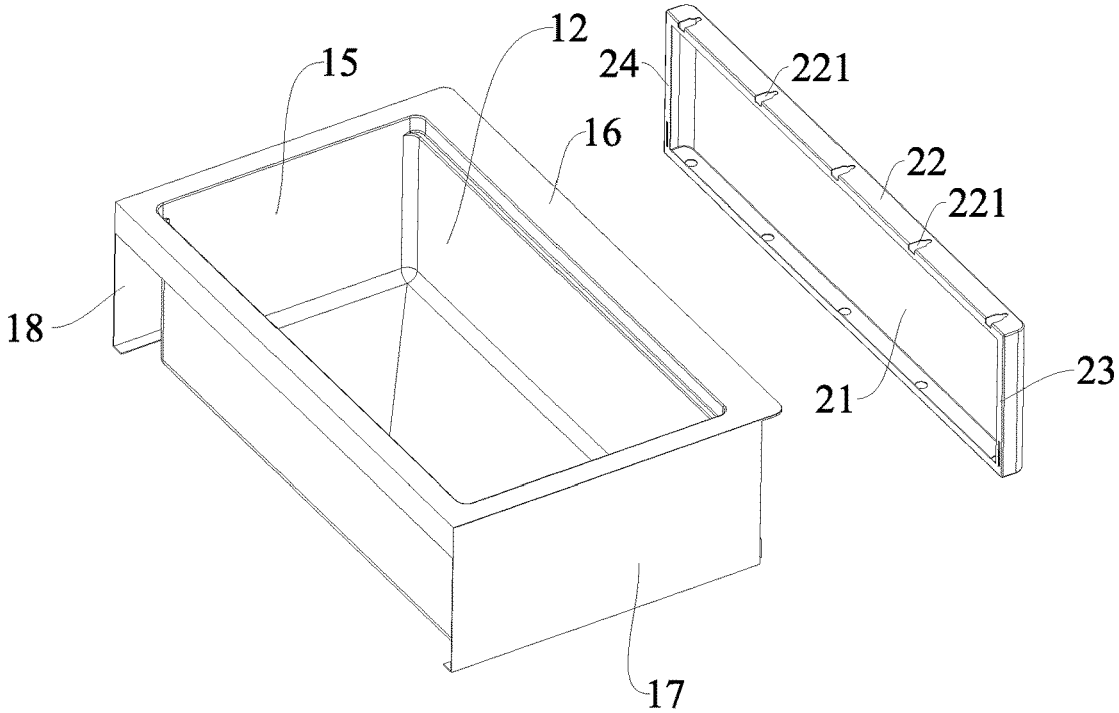
FIG. 3 is an exploded view of the mounting panel in FIG. 2.
Figure 4:
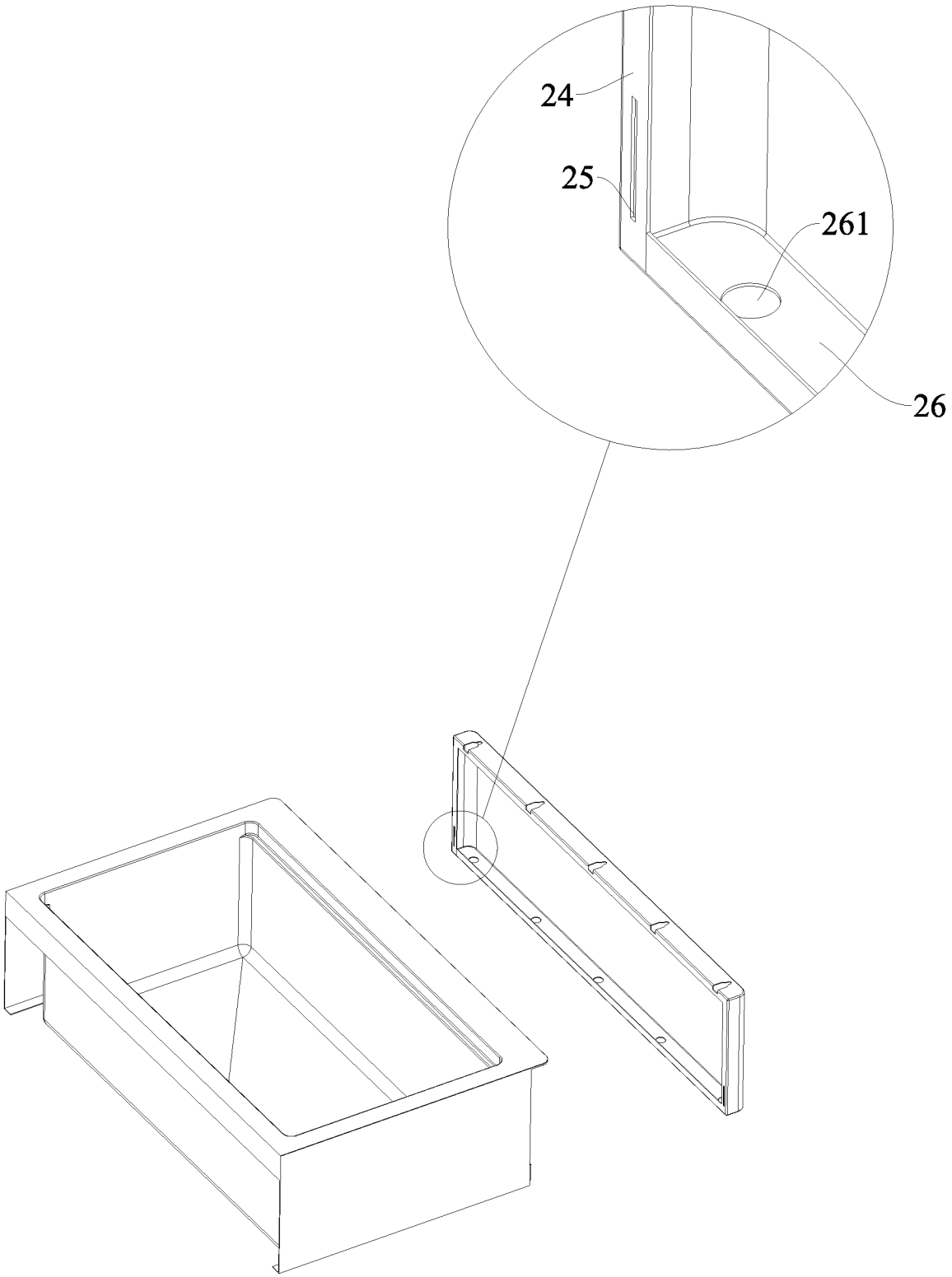
FIG. 4 is a partially enlarged view of the hook hole in FIG. 3.
Figure 5:
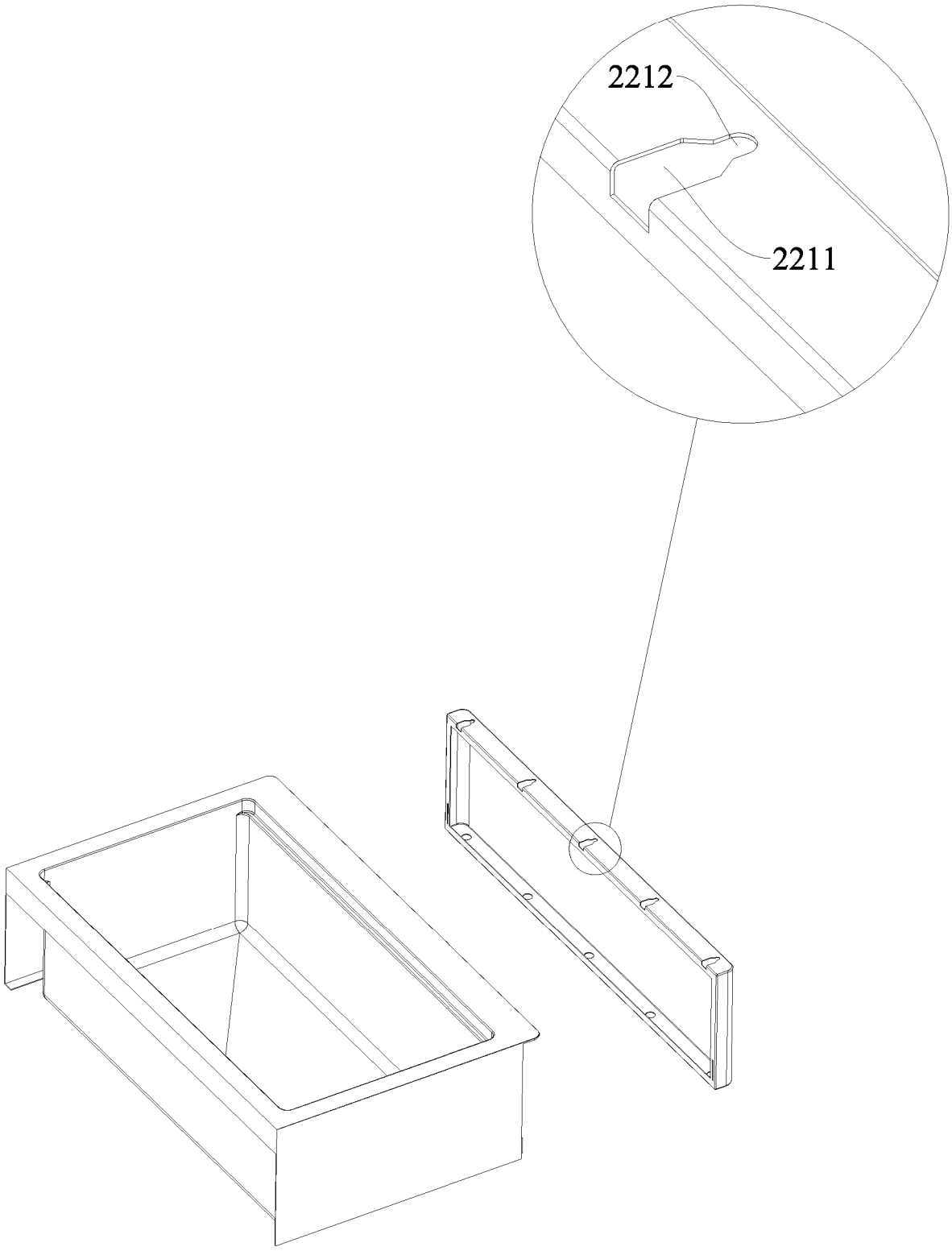
FIG. 5 is a partially enlarged view of the bolt opening in FIG. 3.
Figure 6:
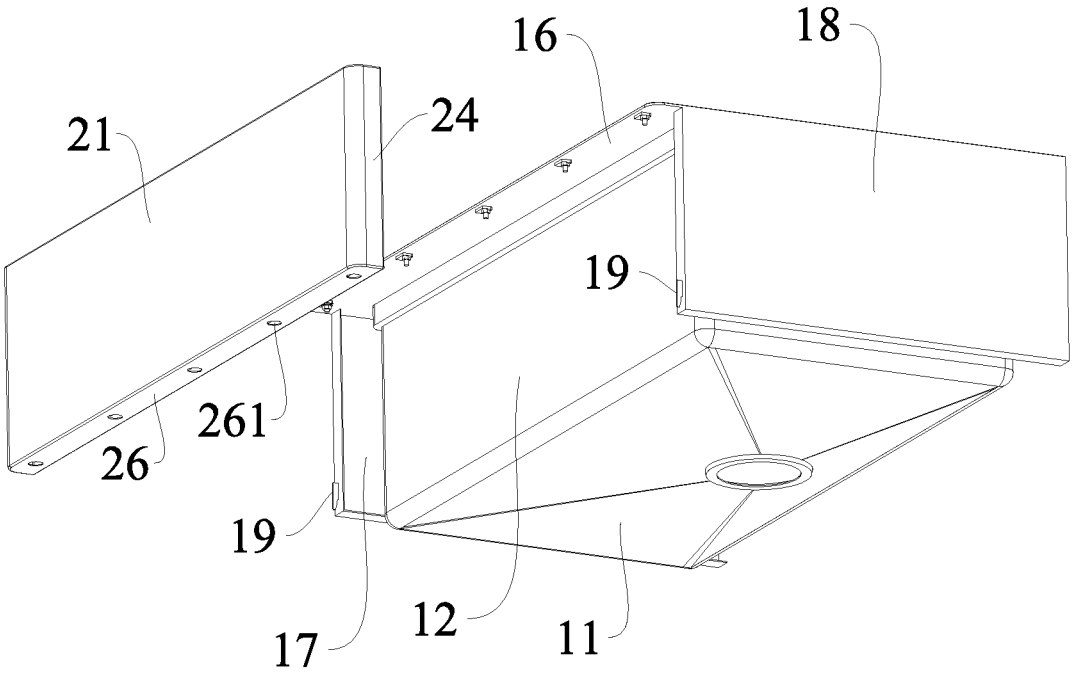
FIG. 6 is an exploded view of the mounting panel from another perspective in FIG. 2.
Figure 7:
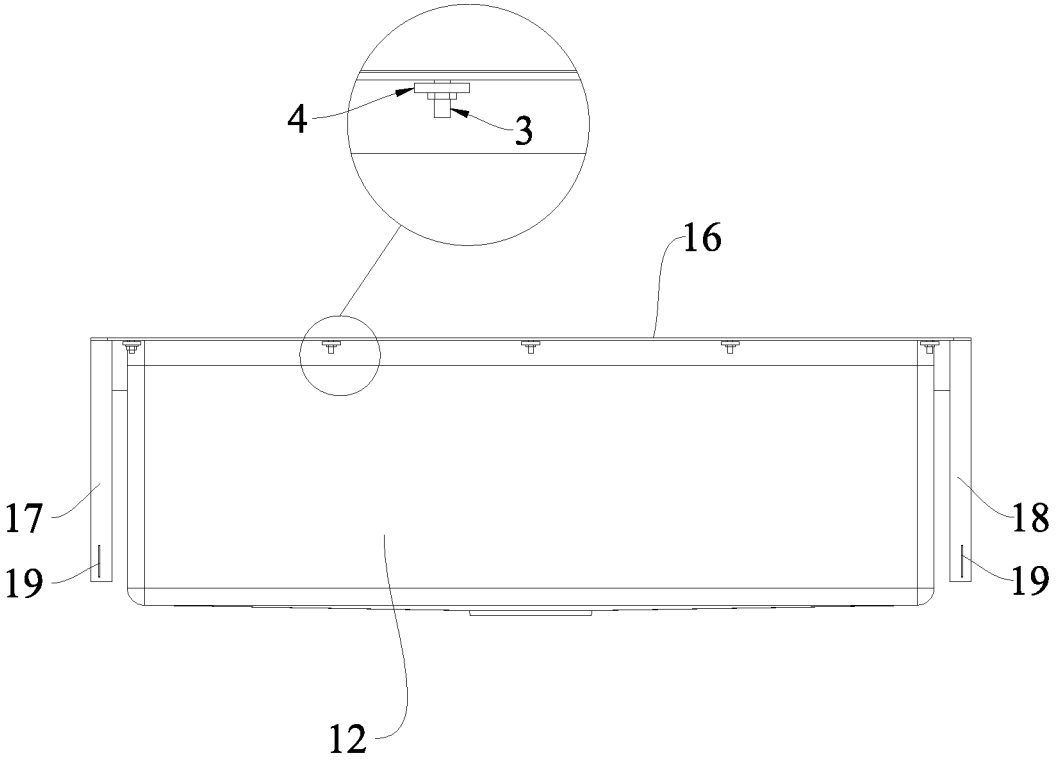
FIG. 7 is a front view of the state without a mounting panel in FIG. 6.

As shown in FIGS. 1-7, an embedded sink as provided in the embodiment of the present application is shown. The embedded sink comprises at least a basin liner 1 and a mounting panel 2, the basin liner 1 comprises a bottom plate 11 and a plurality of side plates, the bottom plate 11 and the side plates are collectively connected to form a cavity having an upper opening. It should be noted that the plurality of side plates here refer to left side plate 14, right side plate 15, front side plate 12 and back side plate 13. The basin liner 1 is suitable for embedded installation in a cabinet, and the front side plate 12 of the basin liner 1 protrudes relative to the cabinet. The mounting panel 2 is structured and arranged to cover the front side plate 12 of the basin liner 1. The mounting panel 2 is detachably connected to the front side plate 12 of the basin liner 1, such that when installing the embedded sink of the present application to different cabinets, users can replace the mounting panel 2 according to the color and material of the cabinet by means of the detachable connection and can avoid damage to the embedded sink, while improving the overall visual consistency of the cabinet.

As a preferred embodiment, referring to FIGS. 3-7, a top plate 16 of the basin liner is provided above the front side plate 12 of the basin liner 1, the top plate 16 is parallel to the bottom plate 11, and the top plate 16 is provided with a plurality of bolts 3, and the plurality of the bolts 3 are disposed downward. The mounting panel 2 comprises a front panel 21 and a bolt connection panel 22; the bolt connection panel 22 is located on a top of the front panel 21, the bolt connection panel 22 is provided with a plurality of bolt openings 221 corresponding to each of the plurality of the bolts 3, each of the plurality of the bolts 3 is configured to be inserted into a respective bolt opening 221. Each of the plurality of the bolts 3 is provided with a nut 4 for locking to the mounting panel 2. That is, in the present application, the detachable connection is achieved by the cooperation of the bolt 3 and the nut 4. Specifically, each opening 221 comprises a fixed opening 2212 and a guiding opening 2211, the fixed opening 2212 matches a diameter of the respective bolt 3, and a width of the guiding opening 2211 is larger than the diameter of the fixed opening 2212. The fixed opening 2212 communicates with the guiding opening 2211. Such an arrangement can facilitate the fitting of the bolt 3 with the bolt opening 221.

Preferably, an outside of the left side plate of the basin liner 1 is provided with a left fastening plate 17, the left fastening plate 17 is parallel to the left side plate, a front side of the left fastening plate 17 is provided with a first hook 19. An outside of the right side plate of the basin liner 1 is provided with a right fastening plate 18, the right fastening plate 18 is parallel to the right side plate, the front side of the right fastening plate 18 is provided with a second hook 19. The mounting panel 2 further comprises a left panel 23 located on a left of the front panel 21 and a right panel 24 located on a right of the front panel 21. The left panel 23 is provided with a first hook hole 25, the right panel 24 is provided with a second hook hole 25; the first hook 19 on the left fastening plate 17 is suitable to cooperate with the first hook hole 25 on the left panel 23. The second hook 19 on the right fastening plate 18 is suitable to cooperate with the second hook hole 25 on the right panel 24. The cooperation of the hooks 19 and the hook holes 25 can make the mounting panel 2 be installed more firmly.

Preferably, the mounting panel 2 further comprises a bottom panel 26 at a bottom of the front panel 21, the bottom panel 26 is provided with a reserved hole 261 corresponding to the fixed opening 2212.

The actual using process of the embedded sink of this present application is as follows, before installing the mounting panel 2, the nut 4 needs to be screwed to the bolt 3 in advance, it should be noted that when the nut 4 is screwed, only a few screw threads need to be screwed so that the nut 4 does not fall, and then fit the hook hole 25 on the right panel 24 with the hook 19 on the left fastening plate 17, and fit the hook hole 25 on the left pane 23 with the hook 19 on the right fastening plate 18, the fit here means to buckle the hook 19 into the hook hole 25, and then install the bolt 3 opening 221 on the bolt 3, it should be noted that, in the process of the bolt 3 opening 221 being engaged with the bolt 3, the guiding opening 2211 is first engaged with the bolt 3, and then the fixing opening is fitted with the bolt 3, finally, use the tool for screwing the nut 4 to protrude from the reserved hole 261 on the bottom panel 26 and tighten the nut 4 to complete the detachable installation of the mounting panel 2. When the mounting panel 2 needs to be removed, use reverse process of the using process above.

The above are only embodiments of the present application, and thus do not limit the patent scope of the present application, any equivalent structure or equivalent process transformation made using the contents of the description and drawings of the application, or directly or indirectly applied to other related technologies Fields, all are included in the scope of patent protection of this application.

What is claimed is:

1. An embedded sink, comprising:

a basin liner;

and a mounting panel;

wherein the basin liner comprises a bottom plate and a plurality of side plates, the plurality of side plates comprising a left side plate, a right side plate, a front side plate, and a back side plate, the bottom plate and the plurality of side plates are collectively connected to form a cavity having an upper opening, and the front side plate of the basin liner protrudes relative to a cabinet; the mounting panel is detachably connected to the front side plate of the basin liner, the mounting panel is structured and arranged to cover the front side plate of the basin liner a top plate of the basin liner is provided above the front side plate of the basin liner, the top plate is parallel to the bottom plate and provided with a plurality of bolts, the plurality of the bolts are disposed downward; the mounting panel comprises a front panel and a bolt connection panel; the bolt connection panel is located on a top of the front panel, the bolt connection panel is provided with a plurality of bolt openings, each of the plurality of bolts corresponding to a respective bolt opening, and each of the plurality of bolts is configured to be inserted into the respective bolt opening, and each of the plurality of bolts is provided with a nut for locking the mounting panel;

each bolt opening comprises a fixed opening and a guiding opening, the fixed opening matches a diameter of a respective bolt, a width of the guiding opening is larger than the diameter of the fixed opening, and the fixed opening communicates with the guiding opening; and an outside of the left side plate of the basin liner is provided with a left fastening plate, the left fastening plate is parallel to the left side plate, a front side of the left fastening plate is provided with a first hook, an outside of the right side plate of the basin liner is provided with a right fastening plate, the right fastening plate is parallel to the right side plate, a front side of the right fastening plate is provided with a second hook; the mounting panel further comprises a left panel positioned on a left of the front panel and a right panel positioned on a right of the front panel, the left panel is provided with a first hook hole, the right panel is provided with a second hook hole; the first hook on the left fastening plate is configured to cooperate with the first hook hole on the left panel, the second hook on the right fastening plate is configured to cooperate with the second hook hole on the right panel.

2. The embedded sink according to claim 1, wherein the mounting panel further comprises a bottom panel at a bottom of the front panel, the bottom panel is provided with a plurality of reserved holes, each reserved hole corresponding to a respective fixed opening.

* * * * *